United States Patent [19]

Waterfield et al.

[11] Patent Number: 5,018,233

[45] Date of Patent: May 28, 1991

[54] LAST

[75] Inventors: Adam P. M. Waterfield, Kettering; Norman R. Waterfield, Wellingborough; David A. Chapman, Rushden; Thomas K. Andrews, Little Billing; Brian Humphrey, Kettering, all of England

[73] Assignee: Geo. J. Cox Ltd., Wellingborough, United Kingdom

[21] Appl. No.: 372,842

[22] Filed: Jun. 29, 1989

[30] Foreign Application Priority Data

Jun. 30, 1988 [GB] United Kingdom ..... 8815560

[51] Int. Cl.[5] ..... A43D 3/00

[52] U.S. Cl. ..... 12/133 B; 12/133 R

[58] Field of Search ..... 12/128 D, 133 R, 141, 12/140, 133 B, 128 C, 142 K; 36/72 R, 77 R

[56] References Cited

U.S. PATENT DOCUMENTS

| | | | |
|---|---|---|---|
| 540,897 | 6/1895 | Blake | 12/133 B |
| 549,480 | 11/1895 | Adler | 12/133 R |
| 1,401,365 | 12/1921 | Ryan | 12/133 R |
| 1,461,469 | 7/1923 | Webster | 12/133 R |
| 1,470,651 | 10/1923 | Stewart | 12/141 |
| 1,586,837 | 6/1926 | Perkins | 12/128 D |
| 3,241,166 | 3/1966 | Jonas | 12/133 R |
| 3,935,609 | 2/1976 | Brotchie | 12/128 D |
| 4,523,345 | 6/1985 | Mateo | 12/133 R |

FOREIGN PATENT DOCUMENTS

| | | | |
|---|---|---|---|
| 1056920 | 3/1954 | France | 12/133 R |

*Primary Examiner*—Steven N. Meyers

*Attorney, Agent, or Firm*—Scrivener and Clarke

[57] ABSTRACT

The last for making boots and shoes comprises a main body portion (1) and a detachable toe portion (2). The two are held together during lasting by means of a peg (3) engaging in a hole (4) in the toe portion. When the last is to be removed from the shoe, only the main body portion (1) is removed, the toe portion (2) remaining in place. This enables shoes of complex toe shapes to be made.

6 Claims, 2 Drawing Sheets

LAST

The present invention relates to lasts. More particularly, but not exclusively, it relates to a last having a detachable toe-end portion.

It is known to manufacture shoes (which term includes all items of footwear made on a last) by shaping the leather or other material around a last. In the case of narrow toed shoes, the last must come almost to a point at the toe-end. Such lasts are easily damaged and may soon need re-modelling. This is expensive and inconvenient.

Since the last must be removed from the finished shoe, the overall shape of the last must be such that removal is not made impossible or difficult. For example, the toe piece must not project from the last in an outstanding manner.

It is an object of the invention to provide a last which overcomes the above disadvantages.

According to one aspect of the present invention, there is provided a last comprising a main body portion, and a toe portion which is detachable from the body portion, and means detachably to connect said body and toe portions in such a manner that the main body portion may be withdrawn from the lasted footwear while the toe portion remains in place.

The connecting means may comprise a peg extending from the body portion. The toe portion has, in this case, a cooperating aperture.

Means may be provided to allow easy location of an insole to the last. For example a front portion of the insole may be shaped to locate within an aperture of the toe portion. This allows very accurate location of the insole on the last.

The toe portion may have an integral insole portion.

In an alternative arrangement, exclusively for use in shoes of welted construction, the toe portion is provided with an integrally moulded rib to match that on a ribbed insole, the insole extending only over the body portion of the last except for a front extension portion to locate within an aperture of the toe portion.

Embodiments of the invention will now be more particularly described by way of example and with reference to the accompanying drawings, in which.

.

Figure 2:
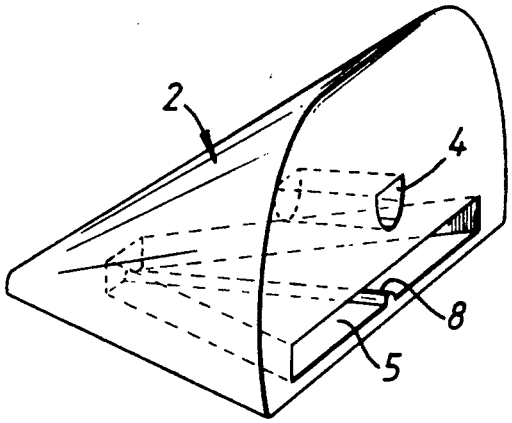
FIG. 2 is a perspective view of the toe piece of the last illustrated in FIG. 1.
Figure 2A:
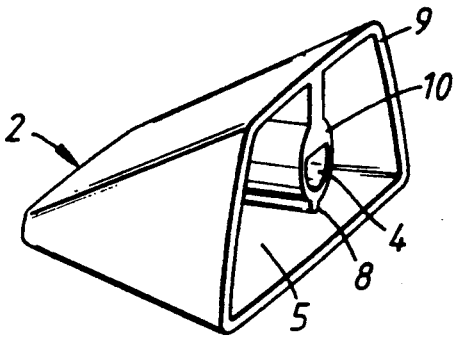
Figure 3:
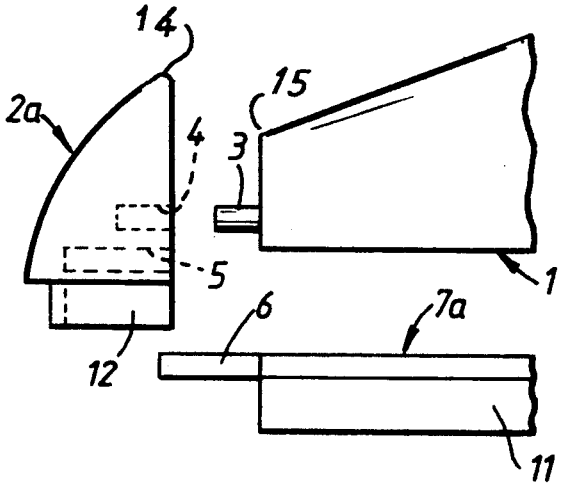
Figure 4:
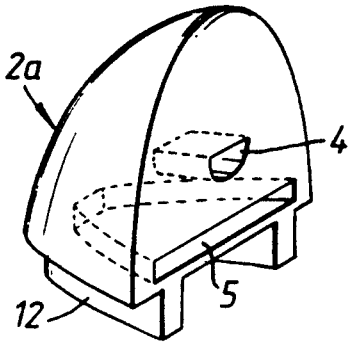
Figure 5:
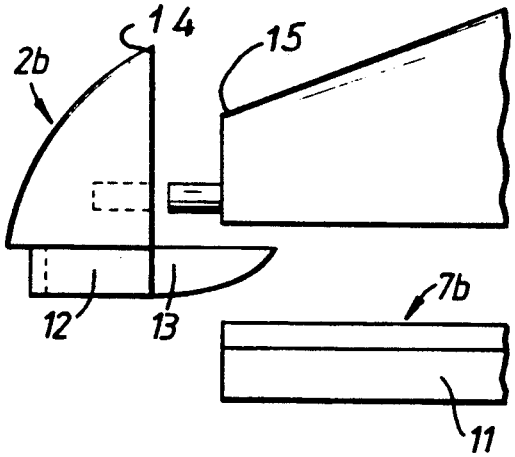
Figure 6:
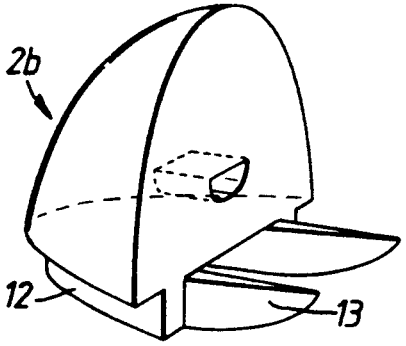

FIG. 2*a* is a perspective view of an alternative, preferred embodiment of toe piece;

FIG. 3 is a schematic side elevation of part of an insole, a last and a toe piece, for use in welted footwear;

FIG. 4 is a perspective view of a toe piece of the last illustrated in FIG. 3;

FIG. 5 is a schematic side elevation of part of an insole, last and toe piece for use in welted footwear; and FIG. 6 is a perspective view of the toe piece of the last illustrated in FIG. 5.

Referring now to the drawings, there is shown a main last body portion 1, and a toe portion 2. The portions are detachably connected by means of peg 3 on the body portion 1 engaging into blind hole 4 in the toe portion 2. The shoe is built around the assembled last, and then only the main body portion 1 is removed. The toe portion 2 remains in place. If so desired it may be coated with adhesive so that it adheres to the upper, although this may not be strictly necessary.

In the embodiments shown in FIGS. 1 to 4 the toe portion 2 is provided with a shaped recess 5 positioned below the blind hole 4 to accommodate a correspondingly tapered shaped toe-end 6 of the insole 7, thereby enabling the insole 7 to be accurately aligned with the toe portion 2. Alignment and security of fit of the tapered insole toe-end 6 are assisted by the provision of a central ridge 8 within the toe portion recess 5. Accurate alignment is imperative, as a small misalignment will adversely affect toe-lasting and subsequent operations. Furthermore, there should only be need for supplementary attachment of the insole to the last at the heel.

In some cases where the toe shape is very extreme, the excess material that forms the lasting allowance at the toe is trimmed, leaving no material for adhesion to the sole at the toe. This can lead to separation at the toe in wear. The separable toe portion provides material to which the upper may be lasted, and which remains in the shoe.

Complex toe shapes may be produced using the last embodying the present invention, since the toe portion of the last need not be removable from the finished shoe. As shown in the Figures, the toe of the finished shoe may have a concave appearance as results where a part 14 of the toe portion of the last has an upper surface extending above the upper surface of the adjacent part 15 of the main body portion of the last. This could not be achieved if the entire last had to be removed.

Finally, each body portion of the last may be used with one of a selection of toe portions, thereby allowing a number of alternatives of the shoe to be produced.

Referring now to FIGS. 3 to 6, there are shown variants in which the toe portion 2*a* or 2*b* is integral with a toe "insole" portion.

In FIGS. 3 to 6, the toe "insole" is ribbed for use in welted shoe manufacture.

The main insole 7*a* is provided with a rib 11 extending around the insole 7 adjacent to its periphery. The rib 12 integral with the toe portion 2*a* of the last continues the line of the insole ribs 11 to the point of the complete insole. This is of particular benefit in the welted construction of footwear on lasts with a narrow toe, where there is considerable difficulty in achieving a uniform rib all around the toe.

Figure 1:
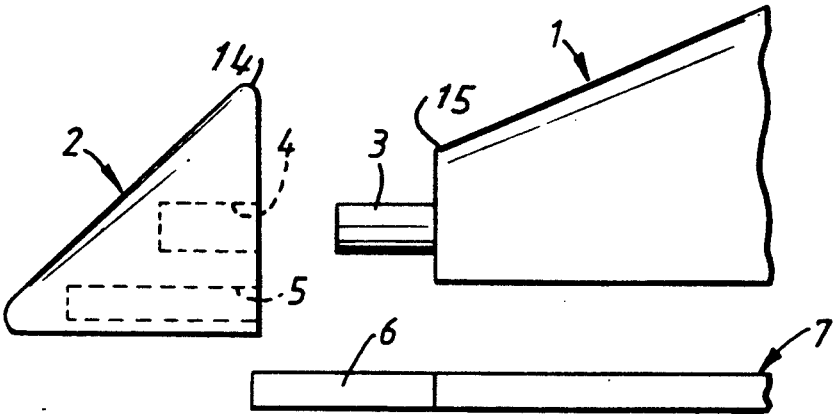
FIG. 1 is a schematic side view of part of an insole, a last and a toe piece embodying the invention, shown in separated condition.

The toe portion 2*a* and body portion of the last are joined by peg 3 and hole 4 as in the embodiment of FIG. 1. Furthermore in FIGS. 3 and 4 the insole 7*a* is joined to the toe portion 2*a* by means of a recess 5 which engages a tapered end 6 of insole 7*a*.

Alternatively, as shown in FIGS. 5 and 6, flanges 13 are moulded to the inside of the "rib" 12 of the toe piece 2*b*, which flanges fit inside the ribbing 11 of the insole 7*b*, ensuring location both vertically and laterally.

Any movement of the insole at toe-lasting is obviated and a substantially perfectly uniform rib around the toe is created.

The embodiment of toe portion 2 illustrated in FIG. 2*a* is of a hollow construction designed to minimise use of material during production. The blind hole 4 is formed by a cylindrical annulus 10 projecting within a shell 9 of the toe piece 2, and the recess 5 simply comprises a gap between the annulus 10 and shell 9.

An important feature of the peg 3 and blind hole 4 in this and other embodiments is that, for security of fitment of the toe piece 2 to the body portion 1 of the last, and to prevent relative rotation therebetween, the peg is not completely circular. For this reason, the hole 4 is illustrated throughout as having a substantially D-shaped cross-section, and it is intended that the peg be of similar cross-section and substantially close-fitting therein. However other shapes may be envisaged.

The toe-portion fits sufficiently firmly to the last to allow a practical single lasting operation of the upper, and detaches when the last is subsequently removed, remaining in the finished shoe.

The process allows a variety of shapes to be utilised with the same body portion of the last, particularly, but not exclusively, convex shapes, which would not be possible by conventional methods of construction which necessitate the ability to remove that part of the last that forms the toe shape (it being an integral part of a single piece last). Careful choice of toe shape and body portion will allow a large number of, if not all, sizes of footwear produced to share a single size of toe portion. In some cases, the toe piece may comprise an integral part of the insole, and the whole may be moulded as one piece.

We claim:

1. A last comprising a main body portion and a toe portion, means for releasably connecting together said portions prior to and during lasting, said releasable connecting means being constructed and arranged to enable said main body portion to be separated from said toe portion while still within lasted footwear following lasting thereof on said last, and the main portion to be withdrawn from said lasted footwear while said toe portion remains in its lasting position within said footwear, said toe portion having an upper surface, at least at an area of connection of said portions, extending above an upper surface of an adjacent part of the main body portion.

2. A last comprising a main body portion and a toe portion which is detachable from the main body portion, in combination with an insole of the footwear to be lasted, said insole having a tapered forward extension cooperable with a recess of the toe portion to allow easy location of the insole, an internal ridge to grip said forward extension being provided in said recess, said toe portion and insole being separable from the main body portion to remain in the lasted footwear when the main body portion is withdrawn.

3. A last for use in footwear of welted construction comprising a main body portion and a toe portion which is detachable on the main body portion, in combination with an insole of footwear to be lasted, means for releasably connecting together said portions prior to and during lasting, said releasable connecting means being constructed and arranged to enable said main body portion to be separated from said toe portion whilst still within said lasted footwear following lasting thereof, and the main portion to be withdrawn from said lasted footwear while said toe portion remains in its lasting position within said footwear, and wherein ribbing is integrally moulded on said toe portion and ribbing is provided on said insole, said insole ribbing matching and aligning with said ribbing on said toe portion.

4. The last according to claim 3 wherein the respective ribbing abut each other in end-to-end relationship whereby the ribbing on said toe portion continues the line of the insole ribbing thereby completing the insole ribbing for welted construction.

5. A last as claimed in claim 3, wherein the connecting means comprises a peg extending from the body portion and a cooperating aperture in the toe portion.

6. A last as claimed in claim 2 wherein said peg and said aperture are non-circular.

* * * * *